US005419597A

United States Patent [19]

Brackmann et al.

[11] Patent Number: 5,419,597

[45] Date of Patent: May 30, 1995

[54] POWER-ACTUATED MOTOR-VEHICLE DOOR LATCH WITH ANTITHEFT OVERRIDE

[75] Inventors: Horst Brackmann, Velbert; Peter Bartel, Hattingen; Frank Kleefeldt, Heiligenhaus, all of Germany

[73] Assignee: Kiekert GmbH & Co. KG, Heiligenhaus, Germany

[21] Appl. No.: 179,968

[22] Filed: Jan. 11, 1994

[30] Foreign Application Priority Data

Mar. 10, 1993 [DE] Germany ..... 43 07 523.1

[51] Int. Cl.[6] ..... E05C 3/06

[52] U.S. Cl. ..... 292/201; 292/216; 70/264

[58] Field of Search ..... 70/262–265; 292/201, 216, 336, DIG. 3, DIG. 23, DIG. 65

[56] References Cited

U.S. PATENT DOCUMENTS

| | | | |
|---|---|---|---|
| 3,520,159 | 7/1970 | Swanney | 70/241 |
| 3,653,237 | 4/1972 | DuRocher | 70/264 |
| 4,135,377 | 1/1979 | Kleefeldt et al. | 70/264 |
| 4,342,209 | 8/1982 | Kleefeldt | 70/264 |
| 4,364,249 | 11/1982 | Kleefeldt | 70/264 |
| 4,440,006 | 4/1984 | Kleefeldt | 70/264 |
| 4,669,283 | 6/1987 | Ingenhoven | 70/264 |
| 4,974,886 | 12/1990 | Kleefeldt | 292/201 |
| 4,978,154 | 12/1990 | Kleefeldt | 292/201 |
| 5,078,436 | 1/1992 | Kleefeldt | 292/201 |
| 5,100,185 | 3/1992 | Menke | 292/216 |
| 5,106,135 | 4/1992 | Menke | 292/216 |

*Primary Examiner*—Peter M. Cuomo
*Assistant Examiner*—Tuyet-Phuong Pham
*Attorney, Agent, or Firm*—Herbert Dubno; Andrew Wilford

[57] ABSTRACT

A motor-vehicle door latch has inside and outside locking elements and an actuator having an electric motor having a threaded output spindle and a drive nut threaded directly on the spindle and displaceable by the motor between unlocked, locked, and antitheft positions. An inside lever assembly includes a first inside lever pivoted on the housing and connected directly to the inside locking element for displacement jointly with the inside locking element between locked and unlocked positions and a second inside lever pivoted on the first inside lever and coupled to the actuator drive nut for pivotal displacement jointly therewith between unlocked, locked, and antitheft positions. A spring braced between the first and second levers urges abutments on them into engagement with each other so that when the abutments are spaced apart the spring is loaded. A coupling mechanism in the housing connected between the first inside lever, door handles, an outside locking element, the actuator nut, and a fork-release pawl couples the release pawl to the handles in the unlocked positions of the locking elements and actuator nut for operation of the release pawl by the handles. This mechanism decouples at least the outside handle from the release pawl in the locked position of either of the locking elements or of the actuator nut and decouples the first lever and both handles from the release pawl in the antitheft position of the actuator nut.

5 Claims, 12 Drawing Sheets

FIG. 1A
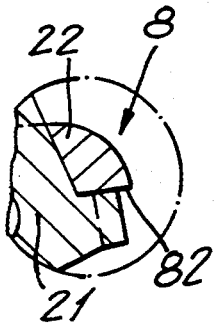
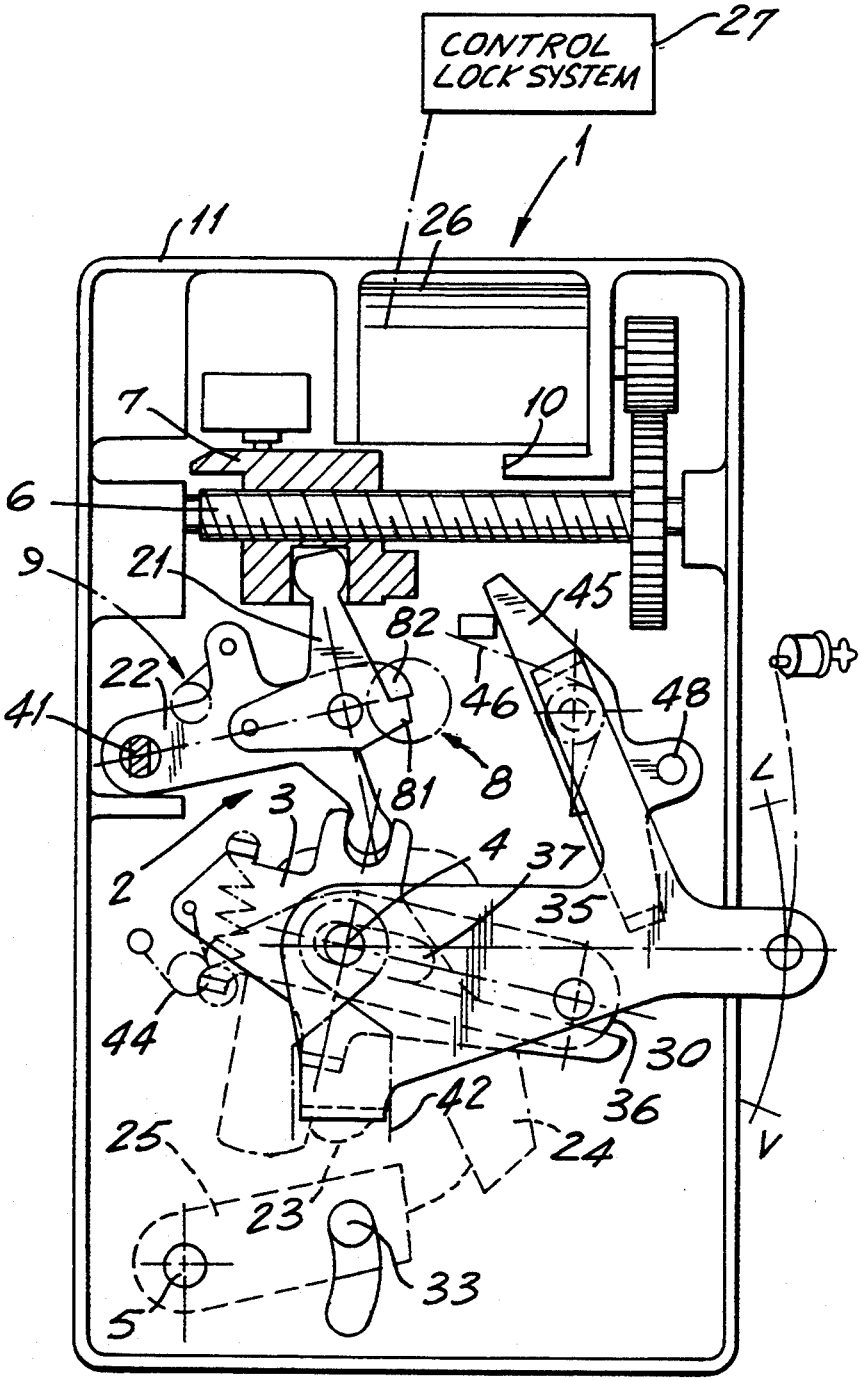
FIG. 1

POWER-ACTUATED MOTOR-VEHICLE DOOR LATCH WITH ANTITHEFT OVERRIDE

FIELD OF THE INVENTION

The present invention relates to a power-actuated motor-vehicle door latch. More particularly this invention concerns such a door latch with an antitheft mode and a manual override.

BACKGROUND OF THE INVENTION

As described in commonly owned U.S. Pat. Nos. 4,974,886 and 5,106,135 a motor-vehicle door latch for use on a vehicle door having a handle and a locking element has a housing, a latch fork pivotal on the housing and engageable in a locking position with a door bolt to retain same and lock the door, an operating lever pivoted on the housing and connected to the handle, a locking lever pivoted on the housing and connected to the respective locking element, and an actuating lever operatively engageable with the fork to release same from the locking position. A link coupled to the locking lever is displaceable thereby between a position coupling the operating lever to the actuating lever for displacement of the fork out of the locking position by actuation of the operating lever and a position decoupling the operating lever from the actuating lever. Thus in the decoupling position actuation of the operating lever will not unlock the door. A central actuator in the latch can displace an antitheft lever into an antitheft position thereof and a mechanism between the antitheft lever and the link decouples the locking lever from the actuating lever in the antitheft position of the antitheft lever so that in the antitheft position actuation of the inside lever will not be able to release the fork.

Typically such a latch is provided with a separate actuator constituted as an electric motor with a rotary threaded output spindle on which is threaded an actuator nut on which is carried a slide. A ratchet-style connection between the slide and the nut allows them to move relative to each other so that in an emergency, for instance when the vehicle battery fails, the latch can be unlocked manually by means of the door key. Such manual actuation forcibly displaces the slider on the nut. In order to reset such a lock, it is therefore necessary that the motor has enough torque to overcome the ratcheting of the slider/nut connection. Hence a relatively strong motor must be used. This increases the size and manufacturing cost of such a latch.

OBJECTS OF THE INVENTION

It is therefore an object of the present invention to provide an improved power-actuated motor-vehicle door latch.

Another object is the provision of such an improved power-actuated motor-vehicle door latch which overcomes the above-given disadvantages, that is which has an antitheft-override feature, but which can use a relatively small actuator motor.

SUMMARY OF THE INVENTION

A power-actuated motor-vehicle door latch has according to the invention a housing, a door bolt engageable in and separable from the housing, a pivotal lock fork in the housing engageable around the bolt, and a release pawl operatively coupled to the lock fork and pivotal in the housing between a blocking position retaining the fork locked around the bolt and a freeing position permitting the fork to release the bolt. Inside and outside locking elements accessible and actuatable respectively from inside and outside the door are displaceable between respective locked and unlocked positions. An actuator has an electric motor having a threaded output spindle and a drive nut threaded directly on the spindle and displaceable by the motor between unlocked, locked, and antitheft positions. In accordance with the invention an inside lever assembly includes a first inside lever pivoted on the housing and connected directly to the inside locking element for displacement jointly with the inside locking element between locked and unlocked positions and a second inside lever pivoted on the first inside lever and coupled to the actuator drive nut for pivotal displacement jointly therewith between unlocked, locked, and antitheft positions. First and second abutments on the first and second levers are directly engaged with each other only in the locked and unlocked positions of the first lever and actuator nut, and are spaced from each other in the antitheft position of the actuator nut. A spring braced between the first and second levers urges the abutments into engagement with each other so that when the abutments are spaced apart the spring is loaded. A coupling mechanism in the housing connected between the first inside lever, door handles, the outside locking element, the actuator nut, and the release pawl couples the release pawl to the handles in the unlocked positions of the locking elements and actuator nut for operation of the release pawl by the handles. This mechanism decouples at least the outside handle from the release pawl in the locked position of either of the locking elements or of the actuator nut. It decouples the first lever and both handles from the release pawl in the antitheft position of the actuator nut.

The spring-loaded two-lever system of this invention replaces the conventional one-piece inside locking lever. It eliminates the necessity for a separate slider and ratchet coupling between the slider and the spindle-mounted actuator nut. On displacement of the latch mechanism into the antitheft position, all that happens is that the spring of the two-lever system is loaded, and it is loaded more as the emergency antitheft-override is used. In other words the latch can be unlocked without displacing the actuator nut. Thus a relatively short stroke can be employed for this nut, as well as a very steep screwthread on the spindle so that the actuator motor can be relatively weak and small and still function perfectly.

According to another feature of the invention the inside levers are relatively pivotal about an axis and one of the inside levers has an axially projecting tab forming one of the abutments and the other inside lever has an angularly directed surface forming the other abutment. In addition the housing is provided with a stop against which the actuator nut bears in the antitheft position.

It is possible in accordance with this invention for a single housing to contain the actuator and inside levers. Alternately a two part housing can have an auxiliary part carrying the actuator and inside levers.

BRIEF DESCRIPTION OF THE DRAWING

The above and other objects, features, and advantages will become more readily apparent from the following description, reference being made to the accompanying drawing in which:

FIG. 1 is a vertical section through the latch according to this invention in the unlocked position;

FIG. 1A is a large-scale view of a detail of FIG. 1;

SPECIFIC DESCRIPTION

Figure 2:
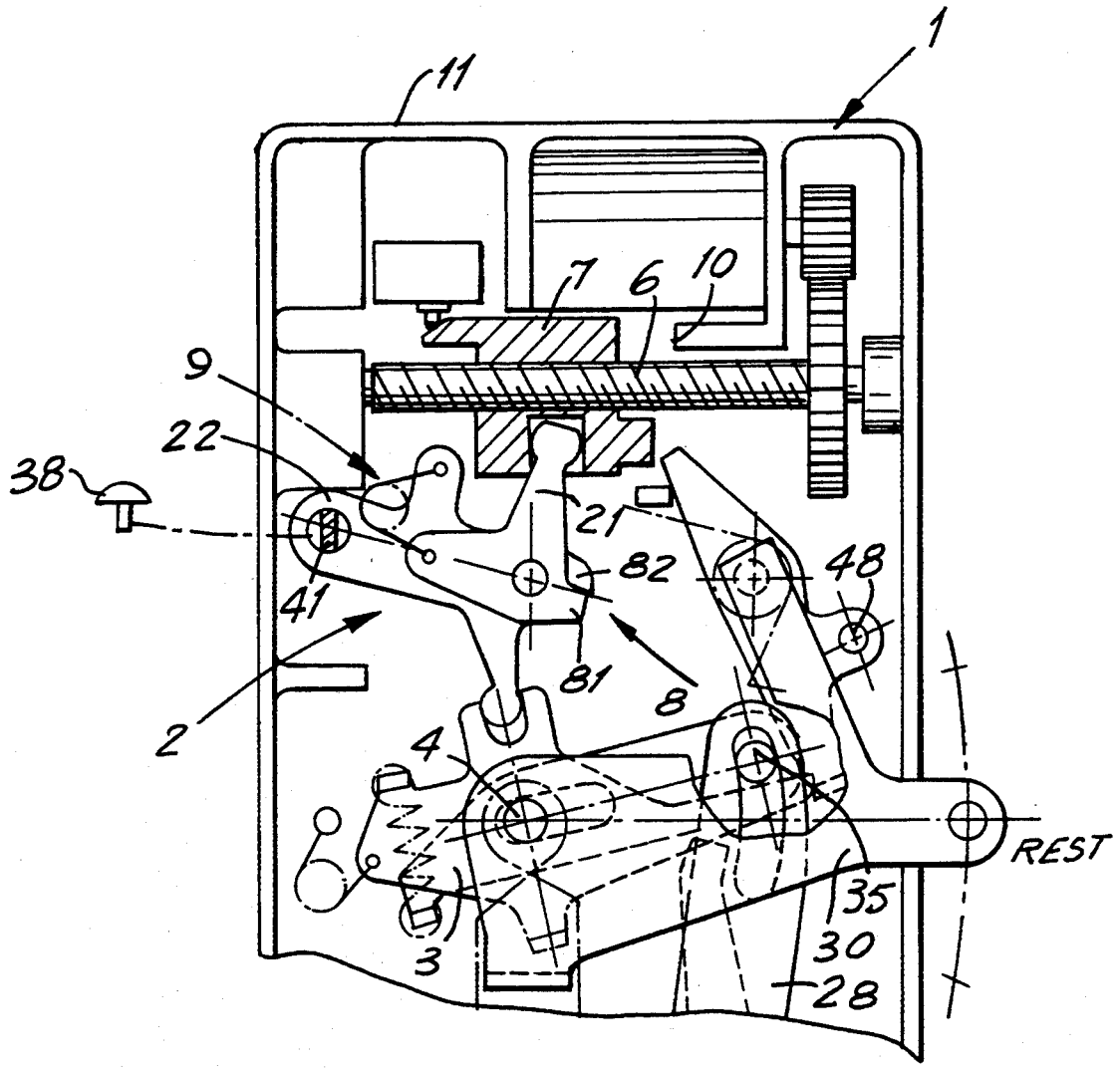
FIGS. 2, 3, and 4 are views like FIG. 1 showing the lock in the locked, antitheft, and emergency-unlock positions, respectively.

As seen in FIGS. 1 through 4 a motor-vehicle door latch has a housing 11 normally mounted on a door edge formed with a cutout into which a bolt 23 (dashed lines in FIG. 1) projecting from the respective door post can engage. A fork 24 pivotal on a pin 4 can engage over this bolt 23 to lock it in place and a latch pawl 25 is pressed by an unillustrated spring to normally engage this fork 24 and hold it in the retaining position.

The latch has a servoactuator, here an electric motor 26, that can be operated by a central lock system shown schematically at 27. This motor 26 operates a threaded spindle 6 carrying a nut 7. The screwthread connection between the spindle 6 and nut 7 is such that the nut 7 can only be moved longitudinally by rotating the spindle 6. An inside operating lever 28 is pivoted on the housing 11 and connected via a rod to an inside door handle 29 and an outside locking lever 39 is connected to an outside door handle 40. An outside locking lever 30 movable between a lock position L, a rest position R, an unlock position U, and an override position O is connected to a cylinder 31 operable from outside the vehicle door and an inside locking lever system comprised of a lever assembly 2 and a lever 3 pivoted on the pin 4 is connected via another lever 41 to an inside door-locking button 38 and to the actuator nut 7. A torque spring 42 carried on the pin 4 can engage a part of the lever 3 as described below. An actuating lever 32 has one arm engageable with a pin 33 on the pawl 25 to release the fork 24 and another arm engageable by a pin 35 carried on a link 36 mounted via a slot 37 on the pin 4. The pin 35 engages through a slot 34 formed in the lever 28 and can either be aligned with the other arm of the lever 32 so that pivoting of the lever 28 operates the lever 32 and opens the latch, or can be out of alignment with the other arm of the lever 32.

Thus in the normal unlocked position of the door the pin 35 (see FIG. 3) is at the bottom of the slot 34. Counterclockwise rotation of the lever 28 effected by the handle 29 or 40 will rotate the lever 28 counterclockwise and cause the pin 35 to engage the upper arm of the lever 32 for joint counterclockwise rotation of the levers 28 and 32. This will push the pawl 25 down, releasing the fork 24. During such counterclockwise pivoting the entire link 36 will be shifted to the left by sliding of the pin 4 along the slot 37. An unillustrated return spring bearing on the pawl 25 will return the elements 28, 3, and 36 normal unlock position when neither of the handles 29 or 40 is actuated, although of course it is standard to provide other return springs also.

The latch is locked by actuating the lock cylinder 31 to rotate the lever 30 counterclockwise and entrain the lever 3 by means of the spring 42 to raise the link 36 and lift the pin 35 past the end of the other arm of the lever 32. This action also pulls down the button 38. Similarly, depressing the button 38 raises the lever 41 which engages the lever assembly 2, pivoting it clockwise so that it engages and pivots lever 3 counterclockwise, also raising the link 36 and lifting the pin 35 past the end of the lever 32. The levers 3 and 36 are connected together by a spring 43 that forms a resilient coupling between these two levers like that formed by the spring 42 between the levers 30 and 3 and a toggle spring 44 of different strength urges the lever 3 into either of the two end positions shown in FIGS. 1 and 3. The actuator 26 can also be operated to push over the nut 7 and operate the lever assembly 2 of the inside door lock button 38. Thus the door latch can be moved into the locked position by the cylinder 31, button 38, or actuator nut 7.

Figure 3:
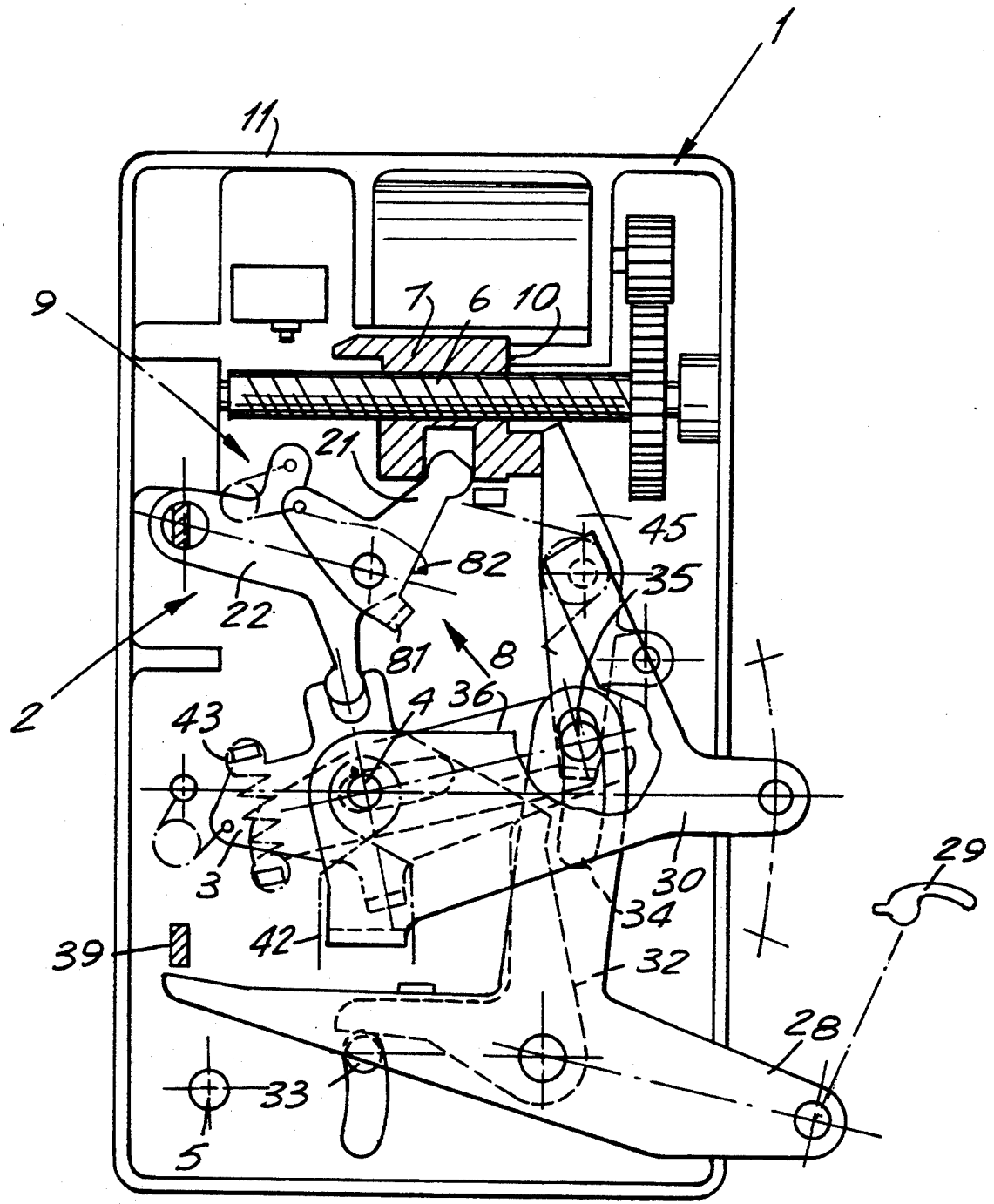
Figure 4:
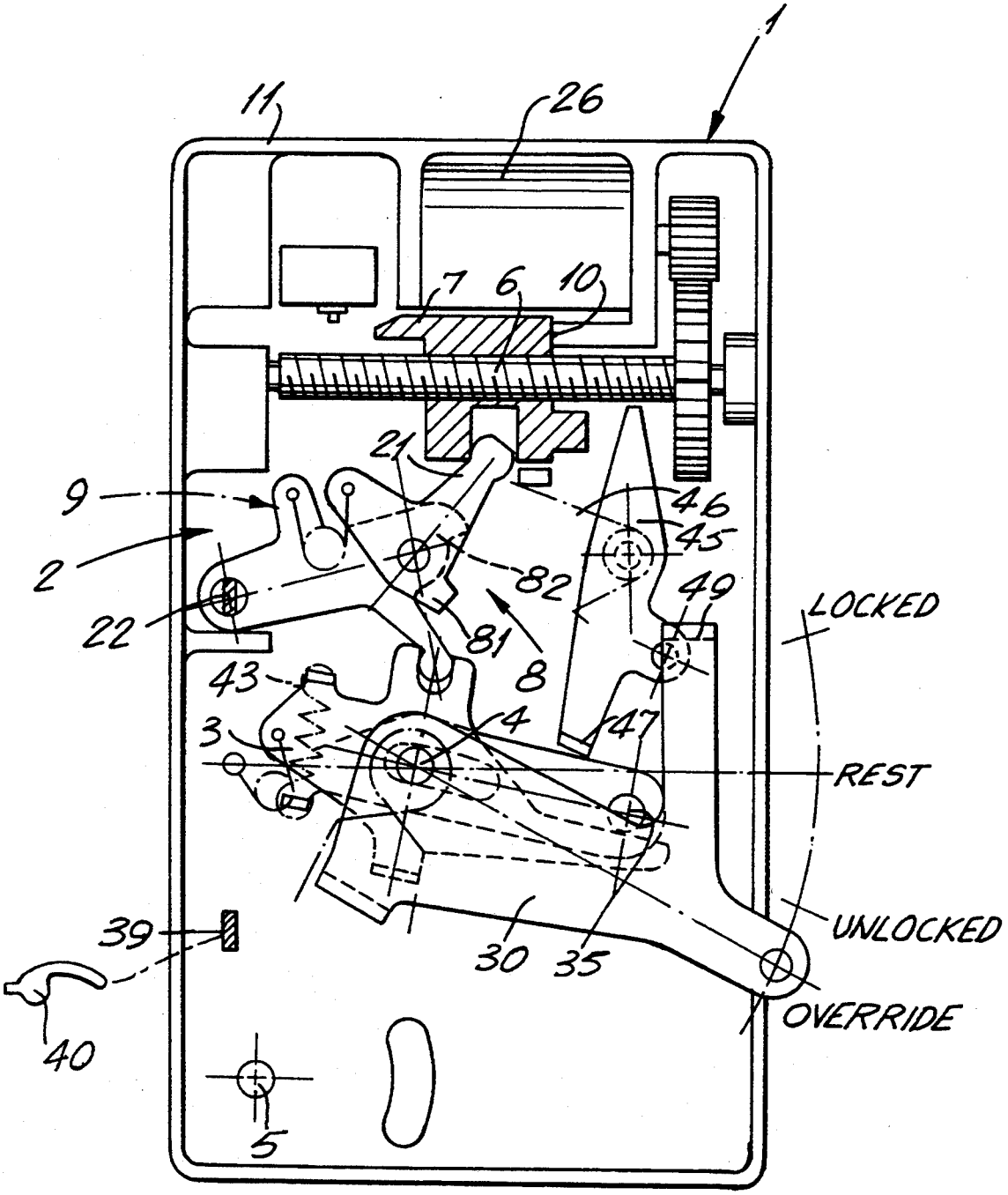
Figure 5A:
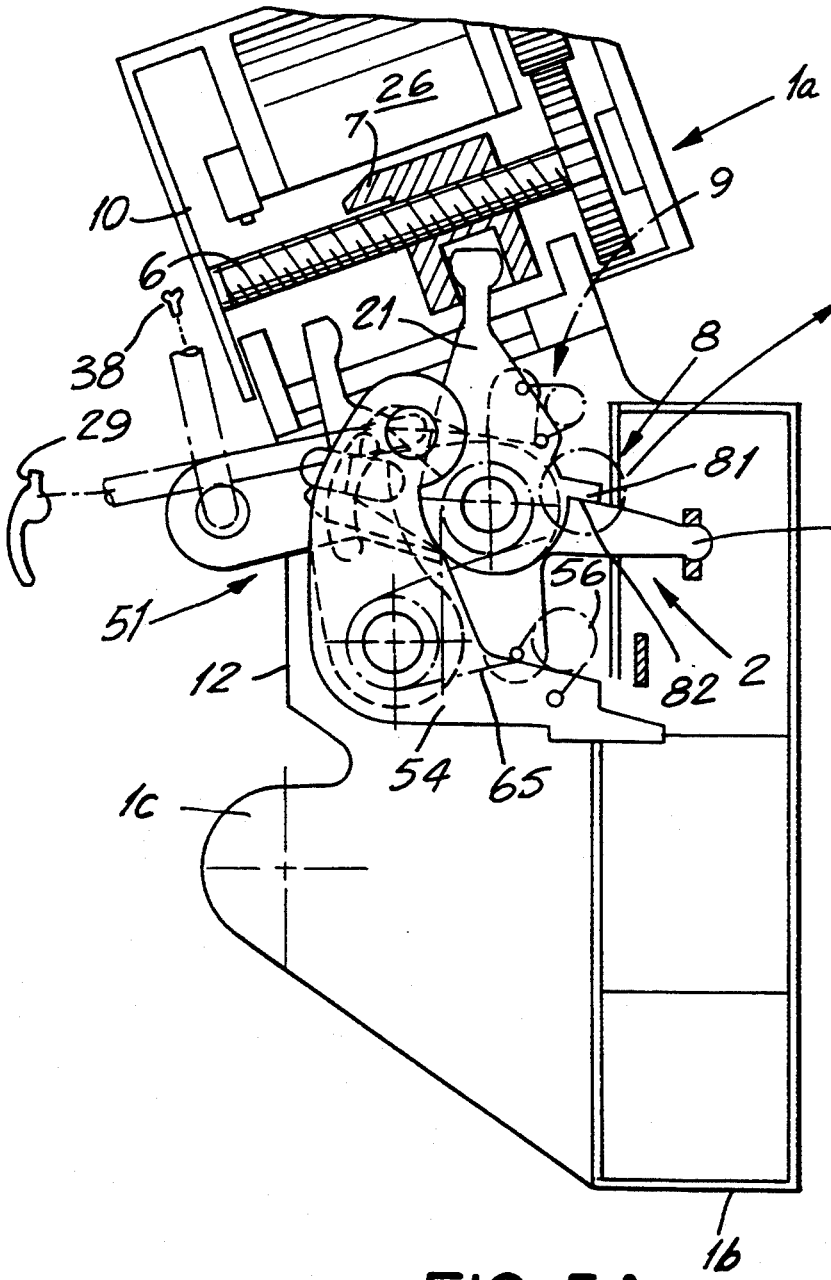
FIGS. 5A and 5B are sections taken through another latch according to the invention in the unlocked position, the sections taken at a right angle to each other.
Figure 5C:
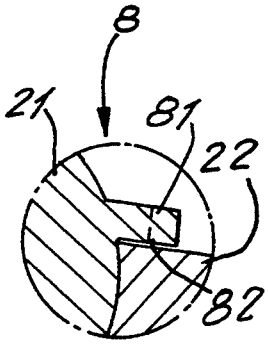
FIG. 5C is a large-scale view of a detail of FIG. 5A.
Figure 5B:
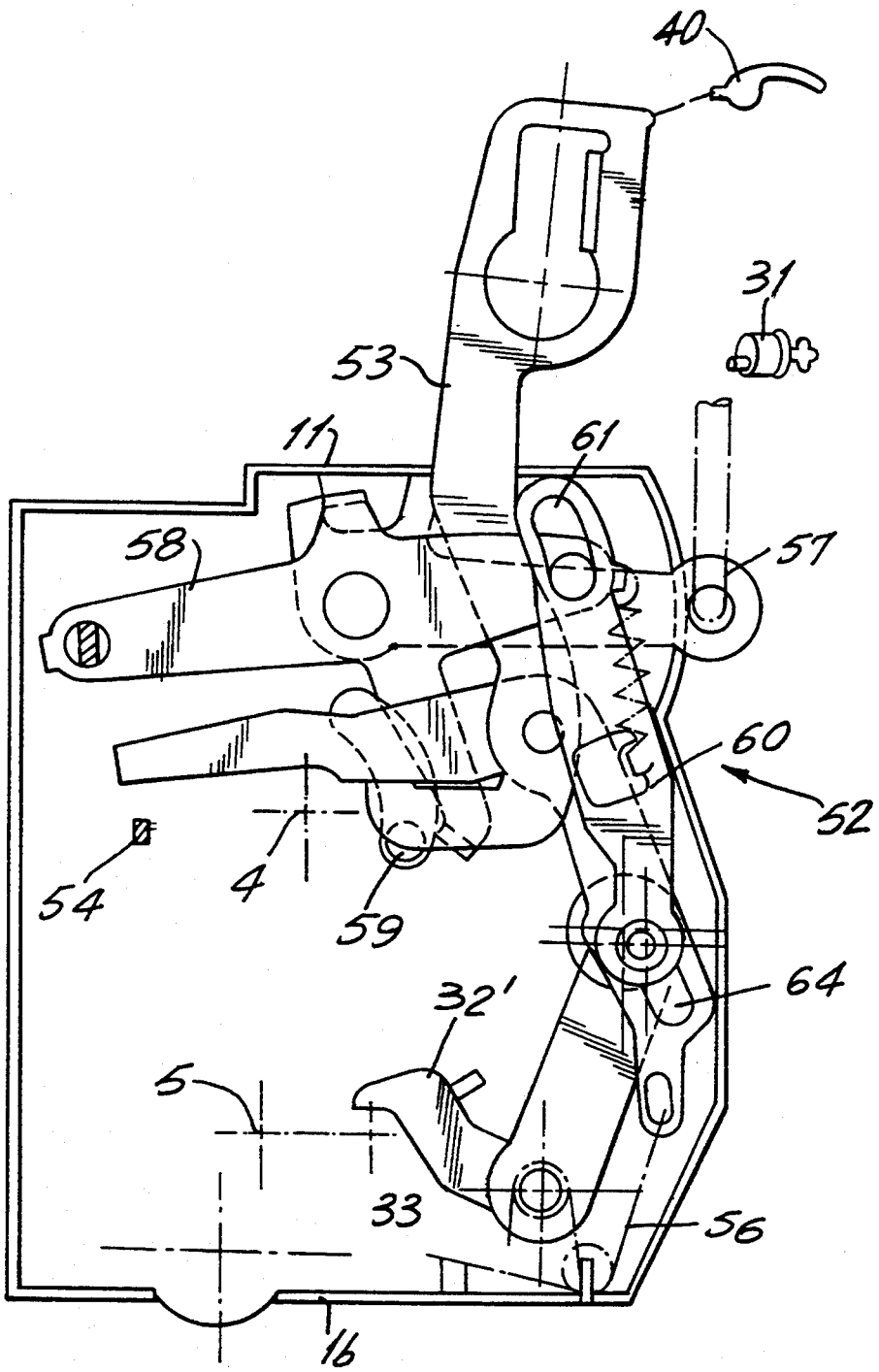
Figure 6A:
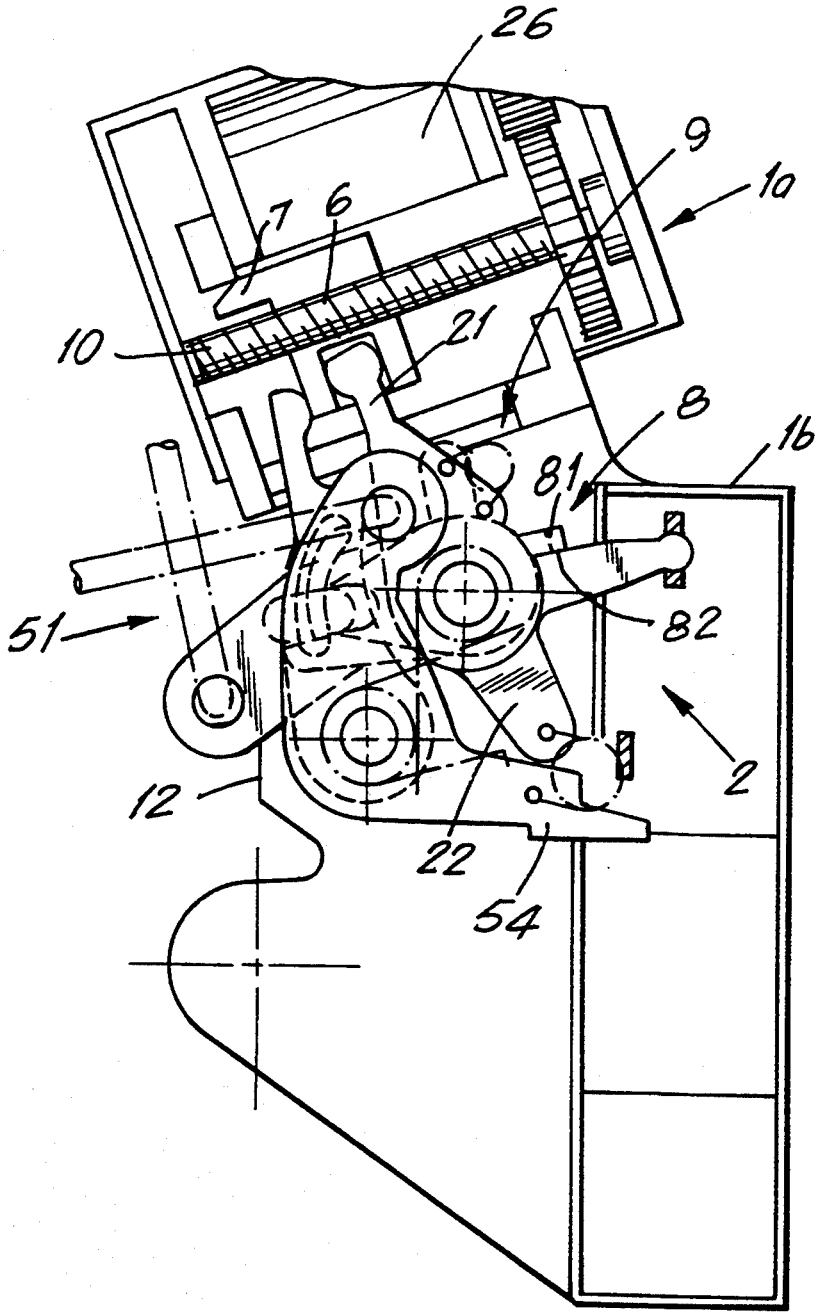
FIGS. 6A and 6B are views like FIGS. 5A and 5B but with the latch in the locked position.
Figure 6B:
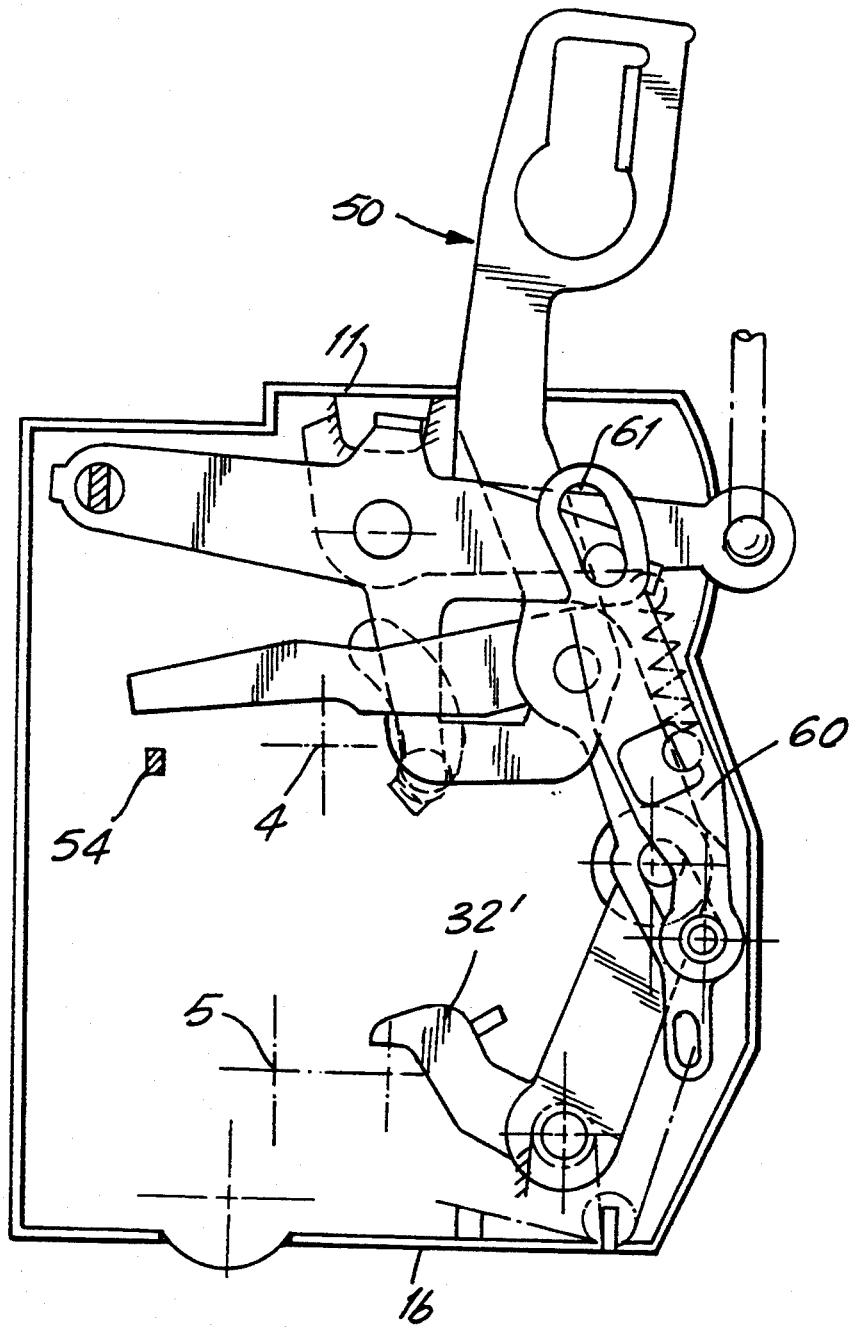
Figure 7A:
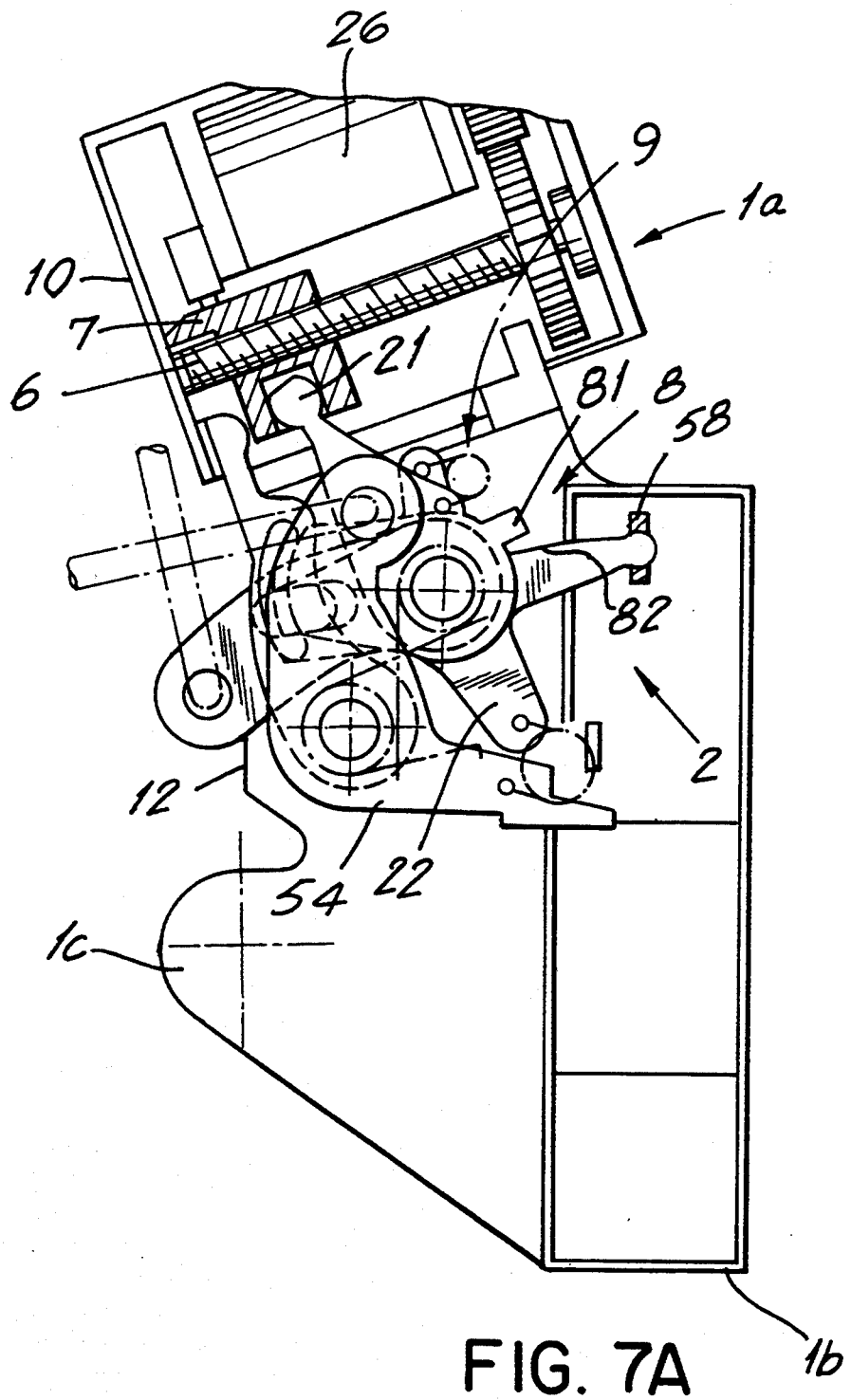
FIGS. 7A and 7B are views like FIGS. 5A and 5B but with the latch in the antitheft position.
Figure 7B:
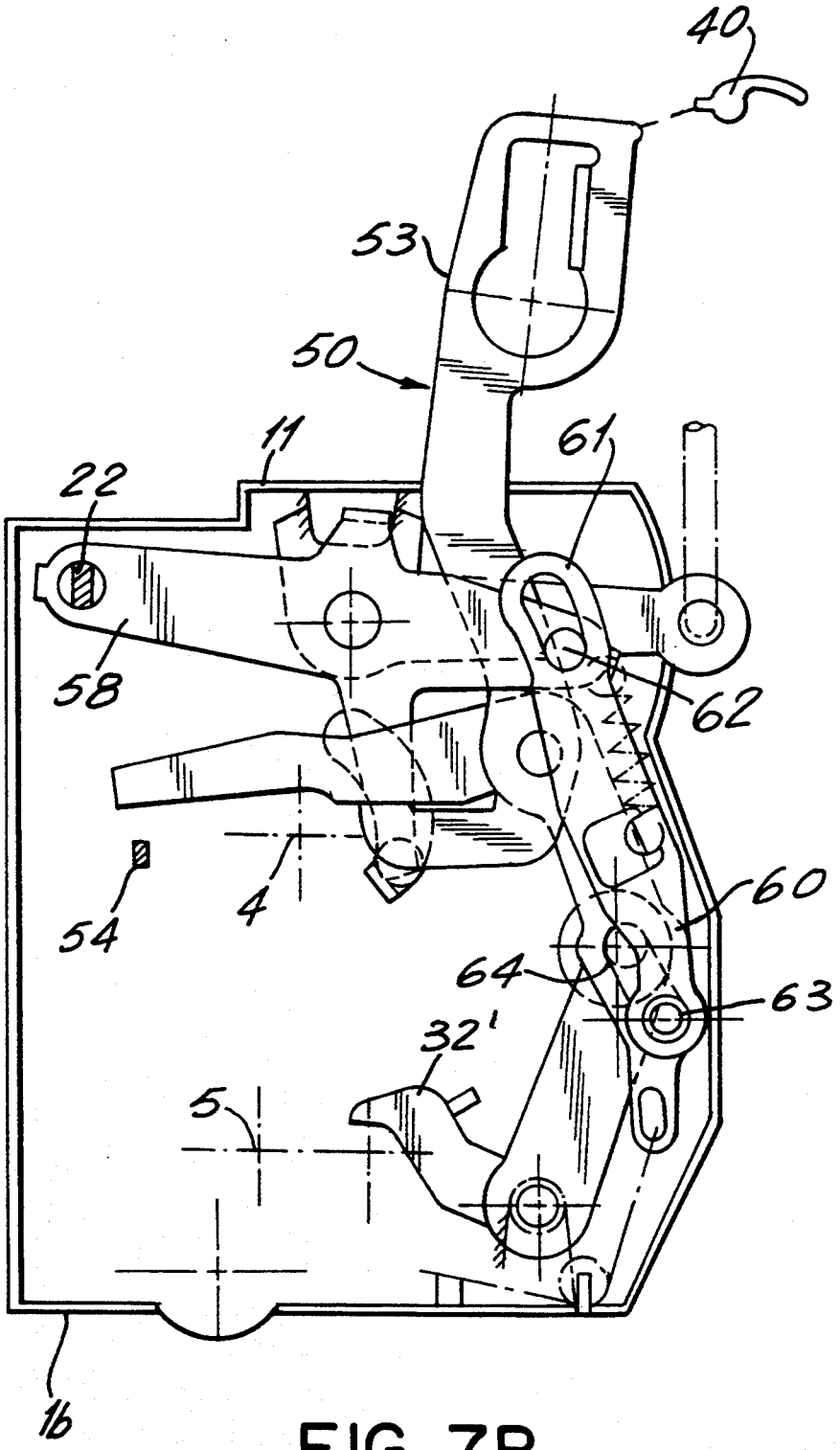
Figure 8A:
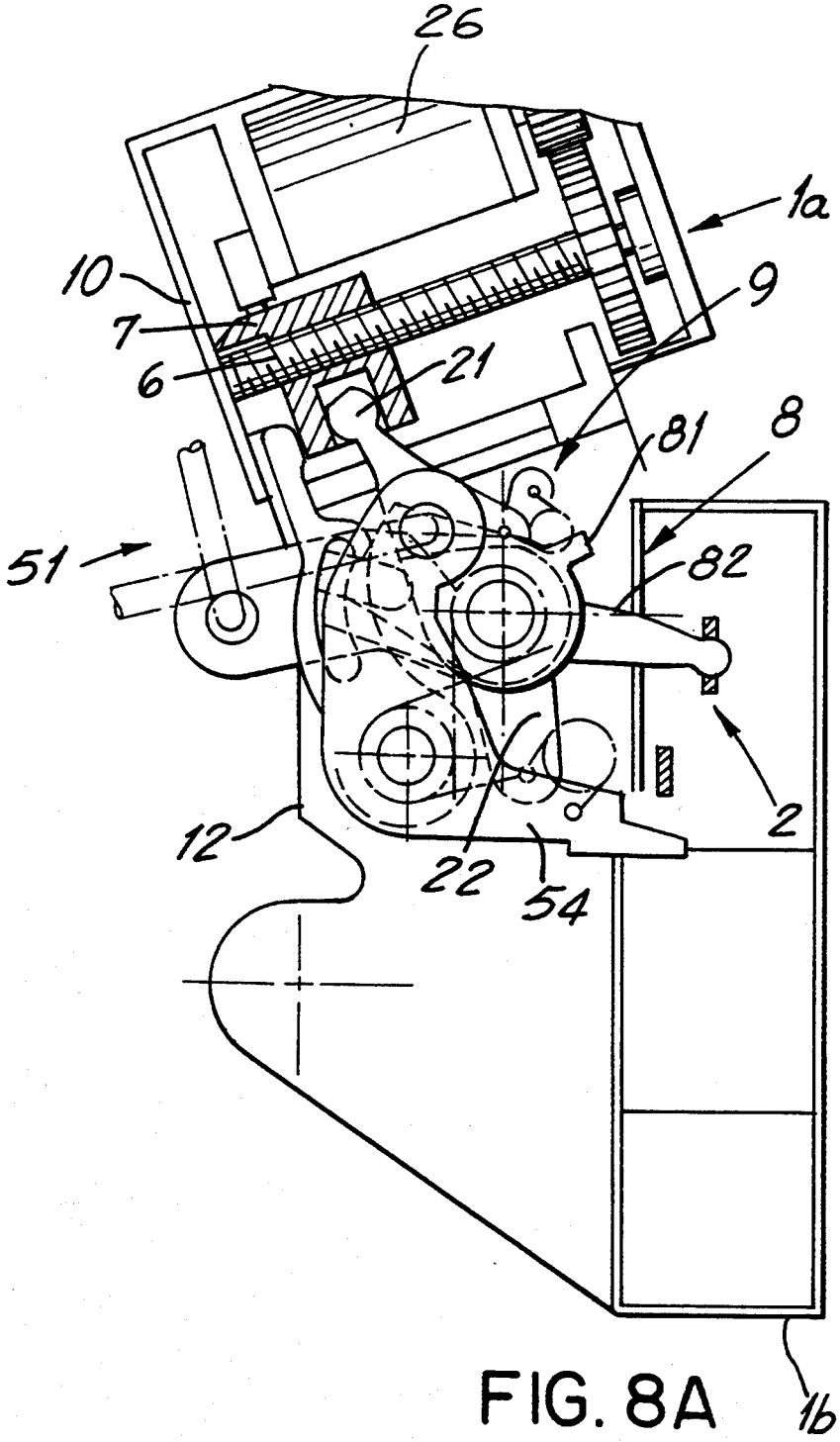
FIGS. 8A and 8B are views like FIGS. 5A and 5B but with the latch in the emergency override position.
Figure 8B:
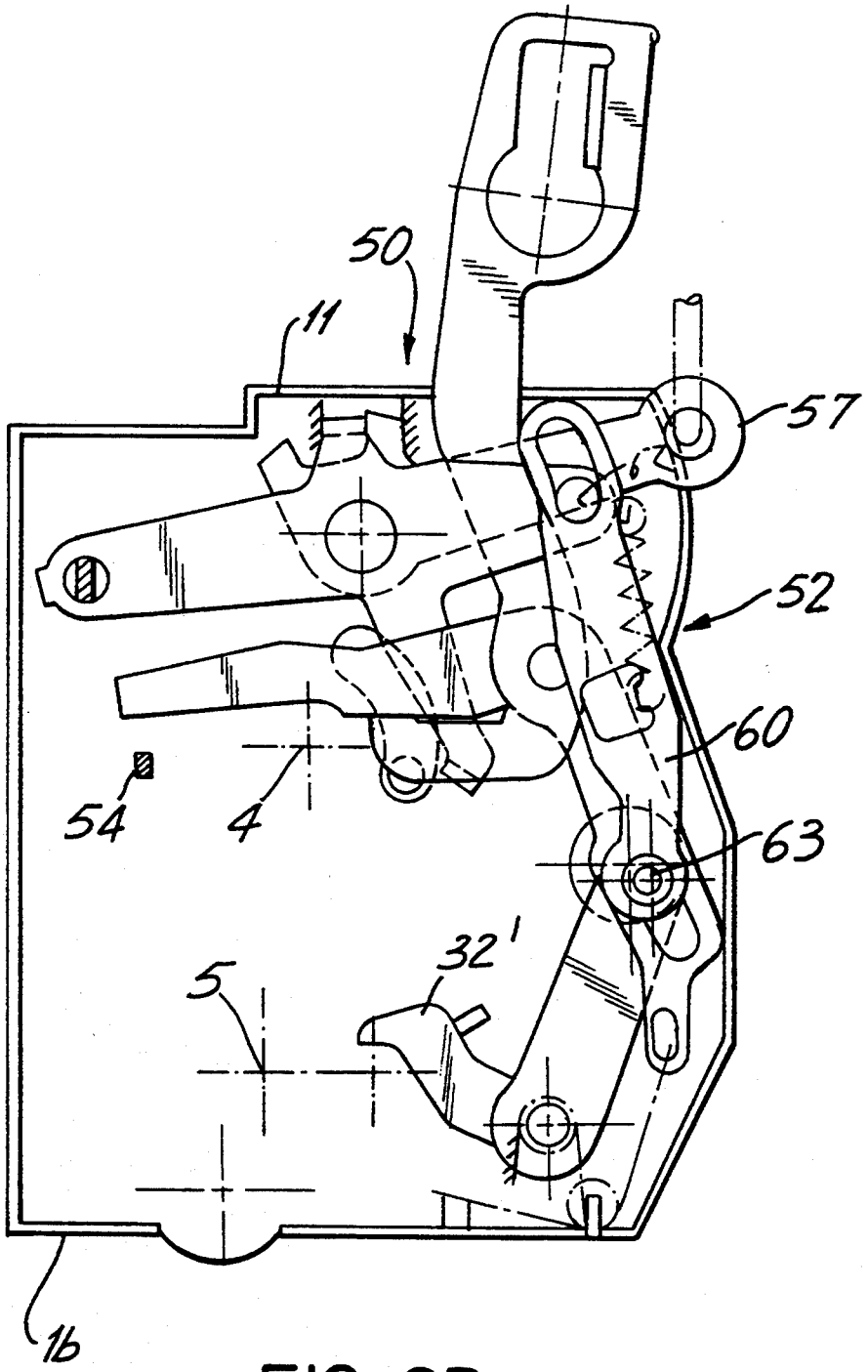

An antitheft lever 45 pivoted on the housing 11 has one end pressed by a biasing spring 46 toward engagement with the spindle nut 7 and an opposite end that is turned up at 47 and that can engage under the pin 35. In addition this lever 45 is provided with an abutment pin 48 that can itself be engaged by a turned over end 49 of the locking lever 30. As shown in FIG. 3 it is therefore possible by rotation of the spindle 6 to screw over the nut 7 and rotate this lever 45 clockwise until the end 47 comes under the pin 35, it being noted that during the first part of such stroke of the nut 7 the latch will be locked by action on the lever assembly 2 and the pin 35 will be lifted to a position above the turned-in end 47. This movement also brings the nut 7 into engagement with the abutment 10. In this antitheft position counterclockwise pivoting of the lever 28 either by means of the handle 29 or 40 will not be transmitted to the lever 32 to unlock the door because the pin 35 will not be able to drop down and engage the lever 32. Similarly in the antitheft position displacement of the lever 30 into the unlock position U will merely tension the spring 42. Thus if the cylinder 31 is set up so that only a specially fitted key can move it into the override position O, a person not equipped with this key cannot unlock the door once the lock is in the antitheft position.

In addition in this antitheft position even if the inside button 38 is forcibly pulled up the resultant clockwise pivoting of the lever 3 will not pivot the link 36 downward because the pin 35 will remain hooked over the lever end 47. Thus even though the spring 43 would normally seek to pull it down with the lever 3 the only effect of the clockwise pivoting of the lever 3 will be in tensioning the springs 42 and 43. Thus in this antitheft position the inside latch button 38 is ineffective. According to this invention when the spring 43 is weaker than the spring 44 any such attempt to open the door by pulling up the button 38 will leave this button 38 in the up position. Alternately the spring 43 could be stronger, in which case the button 38 would snap back down when released.

Although clearly the antitheft position can be canceled by reversing the motor 26 and pulling the nut 7 to the left, in accordance with a further feature of the invention it is possible to release the latch from the antitheft position manually. This is done by actuating the outside lock 31 so that the lever 30 is pushed down below the unlock position U to the override position O. On movement from the position U to the position O the bent-over end 49 of the lever 30 catches on the abutment pin 48 of the lever 45 and pivots it clockwise. This action pulls the end 47 clear of the pin 35 so that the door can be manually unlocked and opened.

According to this invention the lever assembly 2, which is formed by a one-piece structure as shown in above-cited U.S. Pat. No. 4,974,886, is constituted by two separate levers 21 and 22, the former connected to the nut 7 and the latter between the lever 41 and the lever 3. A toggle spring 9 interconnects them and defines for them two stable end positions shown in FIGS. 1 and 4. Furthermore as seen in FIG. 1A the lever 21 has an axially projecting nose or abutment 81 that can angularly engage an abutment 82 to define the FIG. 1 end position.

On movement of the system from the unlocked to the locked position, the two abutments 81 and 82 stay together and the levers 21 and 22 move angularly synchronously. As the nut 7 moves further into the antitheft position, however as shown in FIG. 3, the spring 9 is loaded and the lever 21 pivots relative to the lever 22, separating the abutments. In this antitheft position the nut 7 engages an abutment 10 formed in the housing and the spring 9 is loaded somewhat more.

When in the antitheft position the lever 30 can be tipped down into the override position to further tension the spring 9 and further pivot the two levers 21 and 22 relative to each other. This happens without moving the nut 7. As a result the spindle 6 can have a relatively shallow screwthread for a large mechanical advantage and, as a result, a relatively weak motor 26 can be used. Thus the first lever 21 does not move on displacement between the locked, antitheft, and override positions; all that happens is that the abutments 81 and 82 move relative to each other and the spring 9 is tensioned.

The system described above incorporates the actuator 26 and associated spindle 6 and nut 7 in the lock, mounting them right in the housing 11; FIGS. 5 through 8 show a separate housing **1*a* which is mounted on an angled housing 1*b* of the type shown in U.S. Pat. Nos. 5,100,185 and 5,106,135. Here functionally identical parts have the same references as in FIGS. 1 through 4** and some parts are left out for clarity of view.

The housing part **1*b* contains a latching mechanism 50 serving to operate the release lever 32', a locking unit 51 carried in the associated housing part 1*c* extending at a right angle to the part 1*b*, and a coupling unit 52 that prevents the latching unit 50 from acting on the release lever 32' unless the locking unit 51** is in the unlocked position.

The latching mechanism 50 basically comprises a lever 53 connected to the outside door handle 40, an inside actuating lever 54 connected to the inside door handle 29, and a common actuating lever 55 pivoted on the housing part **1*b* and operable by either of the levers 53 or 54. Springs 56 and 65 bias the levers 53 and 55 into the positions of FIGS. 5A and 5B**.

The locking mechanism 51 basically comprises the inside locking button 38 connected to the inside locking lever assembly 2 movable adjacent the lever 54 between two end positions in which it is held by a toggle spring 56 and the outside locking cylinder 31 connected to an outside locking lever 57. The levers 57 and 22 are respectively carried on the housing parts **1*b* and 1*c* and both are coupled to a common locking lever 58 pivoted on the part 1*b* and having a depending arm that can be engaged by an element 59 on the fork 24** to prevent the latch from remaining locked when the door is closed.

The coupling mechanism 52 basically comprises a coupling link 60 having an upper end formed with a slot 61 into which fits a pin 62 carried on one end of the locking lever 58, and a lower end provided with a pin 63 slidable in a vertically elongated slot 64 formed in one end of the common latching lever 55, and also engageable with an abutment formed on the release lever 32'. This link 60 is vertically displaceable between a lower decoupling position in which the pin 63 is in the lower end of the slot 64 and its arcuate path of travel, which is centered on the pivot axis of the lever 55, is below the release-lever abutment and a decoupling position with the pin 63 in the upper end of the slot 64 and engageable on pivoting of the lever 60 with the abutment.

This system operates substantially as described in above-cited U.S. Pat. Nos. 5,100,185 and 5,106,135. Similarly as described with reference to FIGS. 1 through 4 the two-lever assembly 2 in this arrangement allows a nut 7 to be used that is threaded directly on the spindle 6, with the movement between the locked (FIGS. 6A and 6B), antitheft (FIGS. 7A and 7B), and override (FIGS. 8A and 8B) positions being taken up by the relative movement of the levers 21 and 22.

We claim:

1. A power-actuated motor-vehicle door latch comprising:

a housing;

a door bolt engageable in and separable from the housing;

a pivotal lock fork in the housing engageable around the bolt;

a release pawl operatively coupled to the lock fork and pivotal in the housing between a blocking position retaining the fork locked around the bolt and a freeing position permitting the fork to release the bolt;

inside and outside handles accessible and actuatable respectively from inside and outside the door;

inside and outside locking elements accessible and actuatable respectively from inside and outside the door and displaceable between respective locked and unlocked positions;

an actuator including an electric motor having a threaded output spindle, and a drive nut threaded on the spindle and displaceable the motor between unlocked, locked, and antitheft positions;

an inside lever assembly including a first inside lever pivoted on the housing and connected directly to the inside locking element for displacement jointly with the inside locking element between locked and unlocked positions;

a second inside lever pivoted on the first inside lever and coupled to the actuator drive nut for pivotal displacement jointly therewith between unlocked, locked, and antitheft positions, first and second abutments on the first and second levers directly engaged with each other only in the locked and unlocked positions of the first lever and actuator nut, and spaced from each other in the antitheft position of the actuator nut, and a spring braced between the first and second levers and urging the abutments into engagement with each other, whereby when the abutments are spaced apart the spring is loaded; and coupling means in the housing connected between the first inside lever, the handles, the outside locking element, the actuator nut, and the release pawl for coupling the release pawl to the handles in the unlocked positions of the locking elements and actuator nut for operation of the release pawl by the handles, decoupling at least the outside handle from the release pawl in the locked position of either of the locking elements or of the actuator nut, and decoupling the first lever and both handles from the release pawl in the antitheft position of the actuator nut.

2. The power-actuated motor-vehicle door latch defined in claim 1 wherein the inside levers are relatively pivotal about an axis and one of the inside levers has an axially projecting tab forming one of the abutments and the other inside lever has an angularly directed surface forming the other abutment.

3. The power-actuated motor-vehicle door latch defined in claim 1 wherein the housing is provided with a stop against which the actuator nut bears in the antitheft position.

4. The power-actuated motor-vehicle door latch defined in claim 1 wherein the housing contains the actuator and inside levers.

5. The power-actuated motor-vehicle door latch defined in claim 1 wherein the housing includes an auxiliary part carrying the actuator and inside levers.

* * * * *